219-121 SR
9/8/81 XR 4,288,776

United States Patent [19]
Holmes
[11] 4,288,776
[45] Sep. 8, 1981

[54] PASSIVATED THIN-FILM HYBRID CIRCUITS

[75] Inventor: Robert E. Holmes, Portland, Oreg.

[73] Assignee: Tektronix, Inc., Beaverton, Oreg.

[21] Appl. No.: 110,562

[22] Filed: Jan. 9, 1980

Related U.S. Application Data

[63] Continuation-in-part of Ser. No. 910,178, May 30, 1978, Pat. No. 4,210,500.

[51] Int. Cl.[3] ..... B05D 3/06

[52] U.S. Cl. ..... 338/308; 338/195; 219/121 LH; 219/121 LJ; 29/620; 29/847; 427/53.1; 427/103

[58] Field of Search ..... 427/53.1, 96, 103; 338/195, 308, 309; 219/121 LH, 121 LJ; 29/620, 847

[56] References Cited

U.S. PATENT DOCUMENTS

| | | | |
|---|---|---|---|
| 3,345,210 | 10/1967 | Wilson | 338/308 |
| 3,388,461 | 6/1968 | Lins | 29/620 |
| 3,607,386 | 9/1971 | Galla et al. | 338/308 |
| 3,649,801 | 3/1972 | Cardell et al. | 338/195 |
| 3,665,599 | 5/1972 | Herczog et al. | 29/620 |
| 3,996,551 | 12/1976 | Croson | 338/309 |
| 4,038,517 | 7/1977 | Nelson | 427/103 |
| 4,139,833 | 2/1979 | Kirsch | 338/308 |
| 4,217,570 | 8/1980 | Holmes | 338/308 |

OTHER PUBLICATIONS

Shibata et al., "IEE Trans. Parts, Hybrids & Packaging", vol. PHP-12, No. 3, pp. 223-230, Sep. 1976.
North, "J. App. Phys.", vol. 48, No. 6, Jun. 1977.
Eleccion, "IEEE Spectrum", Apr. 1972, pp. 391-394.
Gagliano et al., "Proc. IEEE", Feb. 1969, pp. 410-413, 426, 427.

*Primary Examiner*—John H. Newsome
*Attorney, Agent, or Firm*—John D. Winkelman

[57] ABSTRACT

Thin-film microcircuit structures passivated with silicon nitride are provided in which included electrical components containing nickel, chromium or other nitride-forming metals are encapsulated in an oxide material, preferably silicon oxide. The metal-containing components are thus prevented from reacting with the silicon nitride passivation coating during through-passivation laser trimming of the components.

10 Claims, 3 Drawing Figures

PASSIVATED THIN-FILM HYBRID CIRCUITS

This is a continuation-in-part of application Ser. No. 910,178, filed May 30, 1978 and issued Aug. 12, 1980 as U.S. Pat. No. 4,217,570.

BACKGROUND OF THE INVENTION

The present invention relates generally to electrical microcircuit structures and to methods for making such structures. More particularly, the invention is concerned with the provision of silicon nitride-passivated hybrid circuits that permit post-passivation trimming of included thin-film circuit elements.

In the manufacture of thin-film and monolithic hybrid microcircuits, passive circuit elements—such as resistors and capacitors—are formed from films of materials only a few thousand angstroms thick. These films typically are deposited on a supporting substrate by vacuum evaporation or cathodic sputtering, with the required patterning being effected simultaneously or in a subsequent procedure. A protective overcoating or passivation film usually is applied to such circuits for environmental protection prior to final packaging, particularly if they will not be sealed within a hermetic enclosure. Silicon nitride ($Si_3N_4$) has found increasing use as a passivation coating material because of its high resistivity and dielectric strength, excellent chemical resistance, and superior electrical and thermal stability.

The values of thin-film electrical components typically fall within a 5-25% tolerance range as fabricated, even with well-controlled processes. More precise values are required in many circuit applications, and in others it may be necessary to adjust component values on an individual basis to "custom-tune" a circuit. This is accomplished by a trimming operation in which portions of a component are physically removed. Airborne abrasive, electric arc and laser beam trimming systems have been developed for this purpose and are commercially available. Laser trimming systems have a number of significant advantages compared to the others, including better accuracy, much greater speed, and cleaner operation. A further important factor is the ability of laser systems to trim circuit components through an overlying passivation film if a laser operating in the visible or near-infrared region is used. This allows a circuit to be adjusted for optimum operation after its fabrication is essentially complete.

In the past it has not been possible to laser trim certain thin-film components in silicon nitride-passivated circuits without damaging the passivation layer. During the trimming of Nichrome and other nickel- or chromium-containing films, for example, voids and cracks in the silicon nitride layer are produced and form an entry point for moisture and contaminants. Because of the superior protection afforded by silicon nitride, there is a need to provide a $Si_3N_4$-protected microcircuit structure that permits post-passivation trimming of included thin-film components containing nickel or chromium. A related need is to provide a method for forming such structures on a variety of substrates.

SUMMARY OF THE INVENTION

The above and other needs have been met, according to the present invention, by the provision of thin-film hybrid microcircuits in which components containing nickel, chromium, or other metals are formed on and covered by contiguous layers of stable oxygen-containing materials. Suitable such materials include the stable oxides of silicon, aluminum, tantalum, titanium and zirconium.

DETAILED DESCRIPTION OF THE INVENTION

As mentioned in the background summary above, post-passivation laser trimming of certain silicon nitride protected thin-film components, most notably those formed of nickel- or chromium-containing materials, has not been feasible because of damage to the passivation layer. Typically, such damage includes the formation of voids in the $Si_3N_4$ layer at the interface between the layer and the edge of the trimmed component. In addition, cracks produced by fracturing of the passivation layer extend from the voids to the outer surface of the protective layer. Such fractures are particularly detrimental if the passivation layer is the sole form of environmental protection for the microcircuit—i.e., if the circuit is not packaged in a separate hermetic enclosure. It is believed that the damage results from the formation of unstable metal nitrides—chromium and nickel nitrides, for example—during the laser trimming operation. Such nitrides are created by chemical reactions between the component's metallic constituents and the $Si_3N_4$ passivation coating as the laser beam vaporizes portions of the thin-film component. The thus-formed nitrides dissociate at the high localized temperatures produced by the trimming operation, and form nitrogen gas that expands and fractures the passivation layer.

Figure 1:
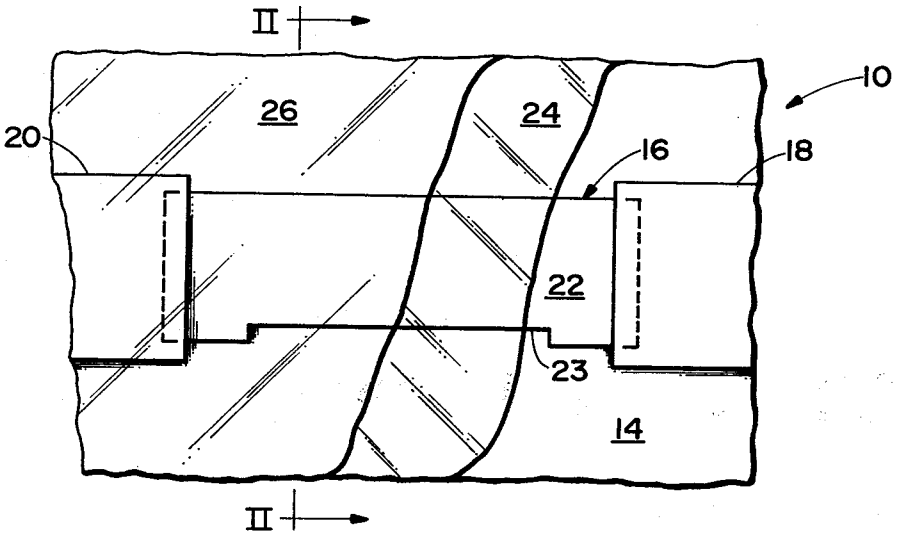
FIG. 1 is a fragmentary plan view of a silicon nitride-passivated thin-film microcircuit structure in accordance with the present invention.
Figure 2:
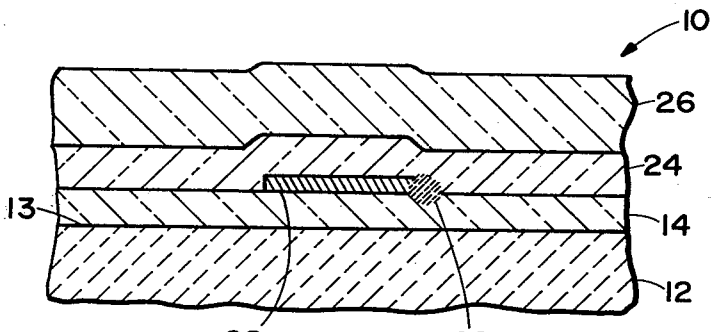
FIG. 2 is a sectional view of the FIG. 1 structure taken along view line II—II.

Referring now to FIGS. 1 and 2 of the drawing, a passivated thin-film hybrid circuit structure not subject to the above-described problem is indicated generally at 10. Circuit structure 10 includes a supporting substrate 12 of conventional composition. The substrate may, for example, be a flat plate of a ceramic material such as high density alumina ($Al_2O_3$) or beryllia (BeO), a glassy material such as fused silica, or a crystalline material such as silicon or quartz. A base layer 14 of an insulating oxide, preferably silicon oxide, formed on a major surface 13 of substrate 12 underlies a thin-film resistor 16. The resistor, which forms a part of a hybrid electrical circuit, includes a pair of electrical terminals 18, 20 overlapping the opposite ends of an elongate resistive film element 22. Element 22 is formed by deposition of a suitable resistance material, such as chromium, a nickel-chromium alloy (e.g., Nichrome), an alloy of chromium and silicon such as $CrSi_2$, or a cermet composed of chromium and silicon oxide. Terminals 18, 20 are defined by conductive metal deposits, typically of gold or aluminum. Overlying resistor 16 is a duplex passivation coating formed by an oxide underlayer 24 and an outer layer 26 of silicon nitride.

Base layer 14 and passivation underlayer 24 function to prevent the formation of metal nitrides during laser trimming. These layers may be formed of any oxide material with the required electrical properties that can be made to adhere satisfactorily to substrate 12 and the hybrid circuit components. Although silicon oxides are preferred for layers 14 and 24, silicon monoxide (SiO) being particularly preferred, other suitable materials include aluminum oxide ($Al_2O_3$), tantalum oxide ($Ta_2O_5$), titanium dioxide ($TiO_2$) and zirconium oxide (ZrO). As shown in FIG. 2, metal constituents of resistive element 22 react with layers 14 and 24 during laser trimming to form stable metal oxides rather that unstable chromium and/or nickel nitrides. These oxides diffuse out into portions of the oxide layers adjacent the trimmed edge 23 of resistance element 22 to form a zone 28 of comparatively high resistivity. As will be understood, layers 14 and 24 must be sufficiently porous to permit such diffusion. Oxide layers formed by thermal oxidation of the substrate, chemical vapor deposition (CVD) or vacuum evaporation have suitable porosity characteristics.

Figure 3:
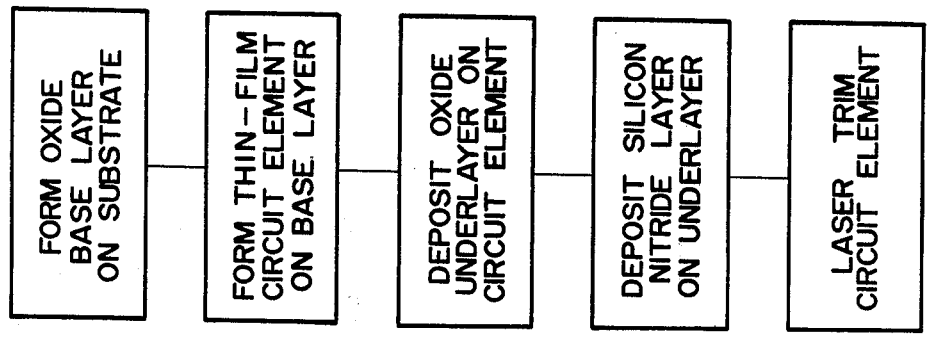
FIG. 3 is a flow chart of a method for providing a trimmed thin-film microcircuit in accordance with the invention.

Referring to FIG. 3, a trimmed thin-film microcircuit of the type shown in FIGS. 1 and 2 is prepared by first forming a stable oxide base layer on a suitable substrate. The base layer may be provided by thermal oxidation if the substrate is a silicon wafer, for example. With other substrate materials, such as alumina, beryllia or fused silica, the oxide base layer may be applied using conventional vacuum evaporation, sputtering or chemical vapor deposition procedures.

Thin-film circuit elements, interconnecting leads and contact pads are next formed on the oxide base layer in a known manner, such as by vacuum evaporation or cathodic sputtering. Procedures for forming thin-film components are well documented in the literature and need not be repeated here. After the circuit elements have been provided on the oxide base layer, a second oxide layer is deposited to cover at least the portions of the elements that will or may be laser trimmed subsequently. This second oxide layer, which preferably is of the same material as the earlier-deposited base layer, coacts with the base layer to encapsulate the circuit elements and prevent undesired reactions between their metal constitutents and the next-deposited layer of silicon nitride when the elements are laser trimmed.

The outer, silicon nitride layer of the circuit structure's passivation coating suitably is applied by chemical vapor deposition to a thickness sufficient for the degree of environmental protection desired, typically about 7,000 to 12,000 angstroms. The oxide base layer and underlayer must be thick enough to prevent fracturing of the passivation coating during laser trimming, and their thicknesses will depend on the thickness of the circuit element being trimmed. By way of example, however, resistance elements formed by the deposition of a 50 ohms per square, 400 angstrom-thick Nichrome thin-film have been trimmed satisfactorily through a duplex passivation coating consisting of a 2,000 angstrom glassy silicon oxide underlayer and an outer layer of $Si_3N_4$ 8,000 angstroms thick. The oxide base layer preferably is of the same thickness as the passivation underlayer, and both should have a minimum average thickness of about 1,000 angstroms.

The final step in the process is to trim the thin-film circuit element to the desired value using a directed laser beam of appropriate wavelength. As described earlier, the metal constitutents—nickel or chromium, for example—of the trimmed circuit elements react with the contiguous oxide layers to form stable oxides that diffuse out into the portions of the layers adjoining the trimmed regions. These metal oxides are of relatively high resistivity and do not significantly affect the value of the thin-film components.

While the best mode presently contemplated for practicing the invention has been set forth, it will be appreciated that various changes and modifications are possible in addition to those specifically mentioned. The appended claims are thus intended to cover all such variations and modifications as come within the scope of the invention.

I claim as my invention:

1. A method for manufacturing a thin-film electrical microcircuit structure containing a laser-trimmed circuit element, which structure includes an unfractured silicon nitride passivation layer, comprising the subsequential steps of:

(a) forming a first layer of an insulating oxide on a substrate, (b) forming a thin-film electrical circuit element on the first oxide layer, said element being formed from a material containing a metal capable of reacting with silicon nitride at the temperature produced by laser trimming of the element to form a metal nitride having a dissociation temperature no higher than the first-mentioned temperature, (c) forming a second layer of an insulating oxide over the circuit element and adjacent portions of the first oxide layer, (d) depositing a layer of silicon nitride over the exposed surface of said second layer, and (e) trimming the thin-film circuit element to a desired value by removing portions of the element with a laser beam directed through said silicon nitride layer and second oxide layer.

2. The method of claim 1, wherein said oxide layers are of an oxide selected from the group consisting of aluminum oxides, silicon oxides, tantalum oxides, titanium oxides and zirconium oxides.

3. The method of claim 2, wherein said oxide layers are formed of a silicon oxide.

4. The method of claim 1, wherein said oxide layers have a minimum average thickness of about 1,000 angstroms.

5. The method of claim 1, wherein said circuit element is formed of a material selected from the group consisting of nickel, chromium, nickel-chromium alloys, chromium-silicon alloys and cermets composed of chromium and silicon oxide.

6. A microcircuit structure comprising a substrate having a first layer of an insulating oxide on a surface thereof, said layer having a minimum average thickness of about 1,000 angstroms, a thin-film electrical component disposed on said first oxide layer, said component being formed from a material containing a metal capable of reacting with silicon nitride at the temperature produced by laser trimming of the component to form a metal nitride having a dissociation temperature no higher than the first-mentioned temperature, and an unfractured protective coating covering said component and adjoining surface areas of the first oxide layer, said coating including a second layer of an oxide deposited to a minimum average thickness of about 1,000 angstroms on said component's and the first oxide layer's surface areas, and an overlying layer of silicon nitride, said structure including a relatively high resistance region within the portions of said oxide layers that adjoin said component, said region being formed by laser trimming of the component through said protective coating and containing a stable reaction product of said metal with the material forming said oxide layers.

7. The microcircuit structure of claim 6, wherein said metal-containing material is selected from the group consisting of chromium, nickel-chromium alloys, chromium-silicon alloys and cermets composed of chromium and silicon oxide.

8. The microcircuit structure of claim 6, wherein said oxide layers are of an oxide selected from the group consisting of aluminum oxides, silicon oxides, tantalum oxides, titanium oxides and zirconium oxides.

9. The structure of claim 8, wherein said layers both are formed of silicon oxide.

10. The microcircuit structure of claim 6, wherein said reaction product comprises a metal oxide selected from the group consisting of chromium oxides, nickel oxides and mixtures thereof.

* * * * *